US006849158B2

(12) United States Patent
Spence et al.

(10) Patent No.: US 6,849,158 B2
(45) Date of Patent: Feb. 1, 2005

(54) PROCESS FOR MANUFACTURING A CELLULOSIC PAPER PRODUCT EXHIBITING REDUCED MALODOR

(75) Inventors: Tameka Spence, Lawrenceville, GA (US); Ralph Anderson, Marietta, GA (US); Tanya T. Hicks, Atlanta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 149 days.

(21) Appl. No.: 10/325,463

(22) Filed: Dec. 20, 2002

(65) Prior Publication Data

US 2004/0118535 A1 Jun. 24, 2004

(51) Int. Cl.[7] ..... D21H 17/05; D21H 17/14; D21H 21/00

(52) U.S. Cl. ..... 162/158; 162/160; 162/207; 422/5

(58) Field of Search ..... 162/158, 160, 162/207; 422/5

(56) References Cited

U.S. PATENT DOCUMENTS

| | | | | |
|---|---|---|---|---|
| 4,670,288 | A | | 6/1987 | Ikari et al. |
| 4,745,129 | A | * | 5/1988 | Ikari et al. ..... 514/502 |
| 4,837,020 | A | | 6/1989 | Mise et al. |
| 4,871,423 | A | | 10/1989 | Grimsley et al. |
| 4,988,505 | A | | 1/1991 | Watanabe et al. |
| 5,080,754 | A | | 1/1992 | Francis et al. |
| 5,300,192 | A | | 4/1994 | Hansen et al. |
| 5,360,515 | A | | 11/1994 | Francis et al. |
| 5,368,689 | A | | 11/1994 | Agnemo |
| 5,607,551 | A | | 3/1997 | Farrington, Jr. et al. |
| 5,830,382 | A | | 11/1998 | Tieckelmann et al. |
| 5,888,350 | A | | 3/1999 | Tieckelmann et al. |
| 6,149,767 | A | | 11/2000 | Hermans et al. |
| 6,254,724 | B1 | | 7/2001 | Seltzer et al. |

FOREIGN PATENT DOCUMENTS

JP 63-035637 2/1988

OTHER PUBLICATIONS

Cullis, C.F., et al., "Combustion of Cigarette Paper Under Conditions Similar to Those During Smoking", *Cellulose & Its Derivatives,* 1985, Chapter 35, Kennedy et al., eds., Ellis Horwood Ltd.

Huat, L., "The Degradation of Cellulose In Paper Found In Library And Archive Materials", *The Brunei Museum Journal,* 1989, pp. 51–69, vol. 7, No. 1, Published by The Brunei Museum, Brunei Darussalam.

LeVan, S.L., "Chemistry of Fire Retardancy", *The Chemistry of Solid Wood,* 1984, Chapter 14, R. Rowell, editor, Advances in Chemistry Series 207 American Chemical Society.

Shafizadeh, F., "Thermal Degradation of Cellulose", *Cellulose Chemistry and its Applications,* 1985, Chapter 11, Nevell & Zeronian, eds., Ellis Horwood Ltd.

K. Wiik, et al., "Studies on Odour Reduction in TCF Bleached Packaging Paper", *Journal of Pulp and Paper Science,* Sep. 1998, vol. 24, No. 9.

International Search Report from PCT/US 03/028825 dated Feb. 26, 2004.

* cited by examiner

*Primary Examiner*—Peter Chin
(74) *Attorney, Agent, or Firm*—Senniger Powers

(57) ABSTRACT

A process for manufacturing a cellulosic paper product (e.g., paper hand towels) exhibiting reduced malodor upon wetting. The process includes introducing a malodor inhibiting agent comprising isoascorbic acid and/or L-ascorbic acid antioxidants into the aqueous suspension of papermaking fibers from which the paper product is made, depositing the aqueous suspension of papermaking fibers onto a sheet-forming fabric to form a wet web and drying the wet web at high temperature in an oxidative environment to form a dried base sheet. The process of the present invention is particularly suited for reducing malodor released from cellulosic paper products made from through-air dried base sheet material.

28 Claims, No Drawings

PROCESS FOR MANUFACTURING A CELLULOSIC PAPER PRODUCT EXHIBITING REDUCED MALODOR

FIELD OF THE INVENTION

The present invention relates, in general, to processes for manufacturing cellulosic paper products and, more particularly, to such processes which provide cellulosic base sheets or finished products (e.g., hand towels) that release reduced malodor upon re-wetting.

BACKGROUND OF THE INVENTION

Commercial paper products such as hand towels are manufactured from cellulosic base sheets. A cellulosic base sheet is a paper product in its raw form prior to undergoing conventional post-treatments such as calendaring and embossing. In general, cellulosic base sheets are made by preparing an aqueous suspension of papermaking fibers and injecting or depositing the suspension onto an endless sheet-forming fabric to form a wet-laid web, which is then dewatered and dried to produce a base sheet suitable for finish processing.

Because of its commercial availability and practicality, through-drying is often used to dry base sheets. Through-drying involves removing water from a wet-laid web by passing a heated gas (e.g., air) through the web. More specifically, through-air drying typically comprises transferring a partially dewatered, wet-laid web from a sheet-forming fabric to a coarse, highly permeable through-drying fabric. A stream of heated air is passed through the wet web carried on the through-drying fabric as it runs over the high permeability rotating cylinder or drum of a through-drying apparatus. As the hot, dry air contacts the wet web, water is evaporated from the web and is transferred to the flow of drying air. Processes for making cellulosic base sheets including through-drying are described, for example, in U.S. Pat. No. 5,607,551 (Farrington et al.) and U.S. Pat. No. 6,149,767 (Hermans et al.), the entire disclosures of which are incorporated herein by reference.

It has been observed that a strong, burnt popcorn-like odor is sometimes emitted from finished paper hand towels when the towels are wetted (i.e., re-wetted after final drying of the base sheet from which the towel is made). Upon investigation, this problem of malodor release has been found to be particularly present in paper products made from cellulosic base sheets that have been through-air dried at relatively high air temperatures. It was hypothesized that over-drying or over-heating of the base sheets was leading to the malodor problem upon re-wetting of the paper product. By operating the through-air drying stage of a base sheet manufacturing process at a lower air temperature and compensating with slightly longer sheet residence time on the drying drum, the malodor problem can be largely eliminated. However, longer residence times in the through-drying apparatus adversely affect the overall productivity of the base sheet manufacturing process.

Therefore, what is lacking and needed in the art is a process which can reduce or eliminate malodor released upon re-wetting of paper products, particularly those made from through-air dried cellulosic base sheets, while allowing higher air drying temperatures and shorter dryer residence times to be used to increase product throughput and productivity.

SUMMARY OF THE INVENTION

Among the several objects of the present invention, therefore, is the provision of a process for manufacturing a cellulosic paper product from a wet-laid web; the provision of such a process wherein the paper products exhibit a reduced malodor upon wetting; the provision of such a process wherein the wet-laid web can be through-air dried at higher temperatures and shorter residence times; the provision of such a process wherein productivity and throughput are increased; and the provision of such a process which is relatively inexpensive and easy to implement.

Briefly, therefore, the present invention is directed to a process for manufacturing a cellulosic paper product comprising forming an aqueous suspension of papermaking fibers, depositing the aqueous suspension of papermaking fibers onto a sheet-forming fabric to form a wet web and through-drying the wet web by passing a heated gas through the web. In accordance with the present invention, a malodor inhibiting agent comprising certain antioxidants, namely isoascorbic acid and/or L-ascorbic acid, is introduced into the aqueous suspension of papermaking fibers. The malodor inhibiting antioxidant can be introduced into the aqueous suspension of papermaking fibers before or after the suspension is deposited onto the sheet-forming fabric. In accordance with a more particular embodiment of the present invention, the malodor inhibiting agent comprises isoascorbic acid, the aqueous suspension of papermaking fibers is deposited onto the sheet-forming fabric to form the wet web after introduction of isoascorbic acid and the wet web is through-dried by passing air heated to a temperature of at least about 175° C. through the wet web.

Other objects and features of the present invention will be in part apparent and in part pointed out hereinafter.

DETAILED DESCRIPTION OF THE PREFERRED EMBODIMENTS

In accordance with the present invention, it has been discovered that a dried, cellulosic base sheet exhibiting reduced malodor upon re-wetting can be produced by introducing a malodor inhibiting agent comprising certain antioxidants into an aqueous suspension of the cellulosic papermaking fibers from which the base sheet is formed. The wet-laid base sheets formed from such aqueous suspensions can be through-dried at higher drying gas temperatures and shortened dryer residence times while significantly reducing malodor produced upon re-wetting the dried base sheets or finished cellulosic paper products made from the base sheets (e.g., hand towels). That is, the previous strategy of employing lower through-drying gas temperatures to reduce malodor formation upon re-wetting is obviated by the practice of the present invention with concomitant improvement in process throughput and productivity.

While the generation of odor in pulp material is not fully understood, it is believed that the odor may be due to extractives in the pulp that are oxidized/reduced during the bleaching and drying process. As part of the present invention, possible reaction mechanisms in the base sheet manufacturing process that may be contributing to the presence of odorous compounds in through-air dried cellulosic base sheets have been investigated. Without being held to a particular theory, it is believed that malodor released upon re-wetting base sheets dried at high temperatures is caused by reactions that form volatile organic compounds or odor precursors during drying. It is believed that these odorous compounds are formed within a cellulosic base sheet during through-air drying and bound within the sheet until the moment that the sheet or a finished paper product made from the sheet is re-wetted. The combination of acid in the sheet and the addition of water upon re-wetting cleaves the odorous compounds from the sheet and releases the compounds into the environment. In particular, experience to date suggests that a large number of the odor-causing compounds released from re-wetted base sheet material can be characterized as medium chain aliphatic aldehydes (e.g., octanal, nonanal, decanal) and/or furans (e.g., furfural, furfuryl alcohol, hydroxymethyl furfural). Thus, it is believed that the presence of volatile aldehyde compounds and/or furan compounds, either alone or in combination, may be responsible for the base sheet malodor. These odor-causing compounds may be produced during high temperature drying of the wet web by any conventional means including Yankee dryers and through-air dryers, but are particularly problematic in through-air dried base sheets, perhaps due to the highly oxidative environment and unique mass transfer phenomena provided by the air stream passing through the web.

Experience to date with analyzing re-wetted base sheets, as described, for example, in Example 1 below, indicates that a substantial component of the malodor released from through-air dried cellulosic base sheets upon re-wetting comprises medium-chain, aliphatic aldehydes having from about 7 to about 10 carbon atoms. Without being bound by a particular theory, it is believed that the aldehydes are formed within the base sheet by the oxidation of fatty acids present in the aqueous suspension of papermaking fibers. For example, during chlorine dioxide bleaching, which is typically conducted under acidic conditions at a pH of about 3.5, fatty acids present in the aqueous suspension of papermaking fibers are either bound by ester linkages to carbohydrates or oxidized to smaller aliphatic aldehydes. Alternatively, aldehydes may be formed in the base sheet during high temperature air-drying, wherein bound fatty acids within the wet web can be oxidized to aliphatic aldehydes by heating.

As water is driven from the wet web during drying, a portion of the aliphatic aldehydes present in the wet web may react with vicinal diols present in the carbohydrates to form acetal linkages, thus binding the aldehydes to the sheet fibers. This acetal formation between the aliphatic aldehydes and vicinal diols in a wet web base sheet is a reversible reaction, with equilibrium between the free aldehyde and bound acetal depending upon the amount of water present. As water is being driven from the wet web, the reaction favors acetal formation. When water is added, and especially in the presence of acid, the acetal will break down to an aldehyde. Therefore, it is believed that when the dried base sheet material is wetted with water (i.e., the sheet material is re-wetted), an acid-catalyzed reversal of the acetal formation reaction liberates the aldehyde, thus releasing the aldehyde from the base sheet material into the environment.

Analyses of organic extracts from re-wetted base sheets have also indicated the presence of furan components, in particular, furfural, furfuryl alcohol and hydroxymethyl furfural. These furans possess a burnt odor substantially similar to the odor released from the base sheets upon being re-wetted with water. Without being bound by a particular theory, it is believed that degradation of carbohydrates present in the base sheet occurs during through-air drying, to generate a furan precursor attached to the carbohydrates. The furan precursor is then liberated and released by an acid-catalyzed reaction when the base sheet material is re-wetted with water. While the liberation step could theoretically occur during further air-drying, it is believed that a rapid loss of water essentially leaves little or no solvent for subsequent reaction.

As noted above, it has been observed that a strong, burnt popcorn-like odor is sometimes emitted when water contacts paper hand towels made from cellulosic base sheets that have been through-air dried at relatively high air temperatures. In accordance with the present invention, it has been discovered that introducing a malodor inhibiting agent comprising certain antioxidants into an aqueous slurry or suspension of papermaking fibers prior to high temperature drying of the wet-laid web in an oxidative environment (e.g., through-air drying) counteracts and substantially reduces the release of malodor upon wetting (i.e., re-wetting) of the dried base sheet material in the final product. More particularly, the malodor inhibiting agent used in the practice of the present invention comprises an antioxidant compound selected from isoascorbic acid (also known as erythorbic acid), its epimer, L-ascorbic acid (also known as vitamin C) and mixtures thereof. It is believed that isoascorbic acid and L-ascorbic acid inhibit the oxidation of unsaturated fatty acids embedded within the pulp or papermaking fibers thereby limiting the formation of volatile, odorous aldehydes. In accordance with a preferred embodiment, the malodor inhibiting agent introduced into the aqueous suspension of papermaking fibers comprises isoascorbic acid, which is believed to be particularly effective in reducing the release of malodor from through-dried base sheet material upon re-wetting.

The amount of isoascorbic acid or L-ascorbic acid employed as malodor inhibiting agent in the practice of the present invention should be sufficient to substantially inhibit the formation of undesirable odors when cellulosic paper products (e.g., hand towels) formed from the dried base sheet are re-wetted. In general, suitable results are obtained by adding the malodor inhibiting agent to the aqueous suspension of papermaking fibers in an amount of at least about 1% by weight based on the weight of papermaking fibers present in the aqueous suspension. Preferably, the quantity of malodor inhibiting antioxidant introduced into the aqueous suspension of paper making fibers is from about 1% to about 10%, more preferably, from about 1% to about 5% by weight based on the weight of papermaking fibers present in the aqueous suspension.

In order to facilitate introduction and dispersion of the malodor inhibiting agent into the aqueous suspension of papermaking fibers, the antioxidant compound may be added to the suspension in a solution comprising a suitable solvent. Any solvent in which isoascorbic acid and/or L-ascorbic acid are sufficiently soluble and that is otherwise compatible with the papermaking process may be employed as the solvent carrier for the antioxidant compound. Since both are readily soluble in water, an aqueous solution of isoascorbic acid and/or L-ascorbic acid may be introduced into the aqueous suspension of papermaking fibers. However, it should be understood that the use of a solvent is simply a preferred expedient for introducing the isoascorbic acid and L-ascorbic acid antioxidants into the aqueous suspension of papermaking fibers and that the practice of the present invention does not require that the malodor inhibiting agent be dispersed in a solvent so long as it is added to the aqueous suspension of papermaking fibers in an unhindered, chemically reactive state so that it can beneficially counteract the production of malodor in the dried base sheet. For example, isoascorbic acid and/or L-ascorbic acid may be added to the aqueous suspension of papermaking fibers as a solid (e.g., crystalline isoascorbic acid).

As will be recognized by those skilled in the papermaking art, the present invention is widely applicable to cellulosic base sheet manufacturing processes that include high temperature drying of the wet-laid web in an oxidative environment (e.g., air), and particularly to those processes in which the wet web is subjected to through-air drying. The practice of the present invention is readily integrated into cellulosic base sheet manufacturing processes and does not materially alter conventional practices except as otherwise noted herein. Conventional papermaking apparatus and techniques can be used with respect to preparation of the aqueous suspension of papermaking fibers or furnish, including pulping and bleaching, the sheet-forming process and tackle, headbox, sheet-forming fabrics, web transfers, transfer fabrics, dewatering, drying, creping, etc. all of which are readily understood by those skilled in the art.

Suitable formation processes include Fourdrinier, roof formers (such as suction breast roll), and gap formers (such as twin wire formers, crescent formers), or the like. Sheet-forming fabrics or wires can also be conventional, with the finer weaves with greater fiber support being preferred to produce a more smooth sheet or web and the coarser weaves providing greater bulk. Fourdrinier formers are particularly useful for making the heavier basis weight sheets useful in the manufacture of paper hand towels and industrial wipers. Headboxes used to deposit the aqueous suspension of papermaking fibers onto the sheet-forming fabric can be layered or nonlayered.

The deposited wet-laid web is preferably partially dewatered before drying. Suitable partial dewatering techniques include vacuum dewatering (e.g., vacuum or suction boxes), air presses, and/or mechanical pressing operations.

The partially dewatered web may be dried by any means generally known in the art for making cellulosic base sheets, including, without limitation, Yankee dryers and through-air dryers. Preferably, a noncompressive drying method that tends to preserve the bulk or thickness of the wet web is employed. The present invention is particularly adapted for reducing objectionable odors emitted by through-air dried base sheets upon being re-wetted with water. Suitable through-drying apparatus and through-drying fabrics are conventional and well-known in the papermaking industry. The inclusion of isoascorbic acid and/or L-ascorbic acid in the aqueous suspension of papermaking fibers counteracts the emission of malodor from the base sheet while permitting the use of desirably higher drying gas temperatures and shorter residence times in the through-drying apparatus, which in turn improves the productivity and throughput of the base sheet manufacturing process. Accordingly, it is preferred that the wet-laid web be through-dried by passing air or other drying gas heated to a temperature of at least about 175° C. through the web. More preferably, the air passed through the web is heated to a temperature of at least about 180° C., more preferably at least about 190° C. Typically, the drying gas temperature for a through-drying operation will be from about 190° to about 220° C., more preferably from about 190° to about 210° C. and especially from about 200° to about 205° C. One skilled in the art can readily determine the optimum drying gas temperature and sheet residence time for a particular through-drying operation.

Papermaking fibers useful in the process of the present invention include any cellulosic fibers that are known to be useful for making cellulosic base sheets. Suitable fibers include virgin softwood and hardwood fibers along with non-woody fibers, as well as secondary (i.e., recycled) papermaking fibers and mixtures thereof in all proportions. Non-cellulosic synthetic fibers can also be included in the aqueous suspension. Papermaking fibers may be derived from wood using any known pulping process, including kraft and sulfite chemical pulps.

In addition to the malodor inhibiting antioxidant, the aqueous suspension of papermaking fibers may contain various additives conventionally employed by those skilled in the art, including, without limitation, wet strength resins (e.g., KYMENE, Hercules, Inc.), fillers and softening agents or debonders.

It is contemplated that the malodor inhibiting agent may be introduced into the aqueous suspension of papermaking fibers at any time during the base sheet manufacturing process prior to final drying of the wet-laid web. For example, the agent may be introduced into the aqueous suspension of papermaking fibers by applying isoascorbic acid and/or L-ascorbic acid to the wet-laid web as it travels from the forming section to the drying section of the base sheet manufacturing process. In such an embodiment, the antioxidant compound is suitably dissolved in an aqueous solvent and the resulting solution sprayed onto the wet-laid web as the web is conveyed past one or more sprayers on the base sheet manufacturing line. The wet web may be partially dewatered prior to the introduction of the malodor inhibiting antioxidant. For example, an aqueous solution of isoascorbic acid may be applied (e.g., sprayed) onto the wet web having a dry weight consistency of from about 20% to about 80% (e.g., 25%, 30%, 35%, 40%, 50%, 60%, 70% or 80%). It is important to apply the malodor inhibiting antioxidant uniformly across the wet web to enhance dispersion of the antioxidant compound throughout the aqueous suspension of papermaking fibers. However, introducing the antioxidant compound into the aqueous suspension of papermaking fibers after formation of the wet-laid web is somewhat less preferred in the practice of the present invention because it is difficult to ensure that the antioxidant is adequately dispersed throughout the wet laid web in the relatively short time that elapses between web formation and final drying. Moreover, introducing the antioxidant compound by spray application onto the wet web may cause the fiber to burn during subsequent drying and exacerbate odor problems.

Accordingly, in the practice of the present invention, it is preferred to introduce the malodor inhibiting antioxidant into the aqueous suspension of papermaking fibers prior to depositing the suspension onto the sheet-forming fabric to form the wet-laid web. Introducing the antioxidant compound into the aqueous suspension of papermaking fibers prior to web formation facilitates dispersion of isoascorbic acid and/or L-ascorbic acid throughout the suspension and longer contact between the antioxidant and the fibers contained therein so that the beneficial effects with respect to odor reduction in the dried base sheet are enhanced. The odor inhibiting antioxidant may be added to the aqueous suspension of papermaking fibers along with conventional additives, such as wet strength resins, which are typically introduced after bleaching and washing of the pulp and before web formation. For example, isoascorbic acid and/or L-ascorbic acid may be suitably added to the aqueous suspension of papermaking fibers in the pulper/machine chest, refiner, furnish tank or other appropriate apparatus used in working up the suspension of papermaking fibers fed to the headbox from which the wet web is deposited. Preferably, the isoascorbic acid and/or L-ascorbic acid is introduced into the aqueous suspension of papermaking fibers while the suspension is being stirred or otherwise agitated in such apparatus to further enhance dispersion of the antioxidant throughout the suspension within a reasonable residence time. In the preferred embodiment where the odor inhibiting antioxidant is introduced before web formation, the aqueous suspension of papermaking fibers into which the antioxidant is introduced typically has a dry weight consistency of no greater than about 20%, more preferably no greater than about 5% and especially no greater than about 2%.

Individual cellulosic paper products made from the base sheets in accordance with the present invention may, include, for example, absorbent hand towels, industrial wipers, tissues, napkins and the like of one or more plies and varying finish basis weights. For multi-ply products, it is not necessary that all plies of the product be the same, provided that at least one ply is made in accordance with the present invention. Suitable basis weights for these products can be from about 5 to about 70 grams/$m^2$. In accordance with a preferred embodiment, the cellulosic paper products have a finish basis weight ranging from about 25 to about 45 grams/$m^2$, even more preferably from about 30 to about 40 grams/$m^2$.

The process of the present invention has not been found to significantly alter the physical properties of the cellulosic base sheet products produced by the process in any capacity other the substantial reduction in the release of malodor upon re-wetting. For example, through-dried cellulosic base sheets produced by the process of the invention generally contain an amount of stretch of from about 5 to about 40 percent, preferably from about 15 to about 30 percent. Further, products of this invention can have a machine direction tensile strength of about 1000 grams or greater, preferably about 2000 grams or greater, depending on the product form, and a machine direction stretch of about 10 percent or greater, preferably from about 15 to about 25 percent. More specifically, the preferred machine direction tensile strength for products of the invention may be about 1500 grams or greater, preferably about 2500 grams or greater. Tensile strength and stretch are measured according to ASTM D1117-6 and D1682. As used herein, tensile strengths are reported in grams of force per 3 inches (7.62 centimeters) of sample width, but are expressed simply in terms of grams for convenience.

The aqueous absorbent capacity of the products of this invention is at least about 500 weight percent, more preferably about 800 weight percent or greater, and still more preferably about 1000 weight percent or greater. It refers to the capacity of a product to absorb water over a period of time and is related to the total amount of water held by the product at its point of saturation. The specific procedure used to measure the aqueous absorbent capacity is described in Federal Specification No. UU-T-595C and is expressed, in percent, as the weight of water absorbed divided by the weight of the sample product.

The products of this invention can also have an aqueous absorbent rate of about 1 second or less. Aqueous absorbent rate is the time it takes for a drop of water to penetrate the surface of a base sheet in accordance with Federal Specification UU-P-31b.

Still further, the oil absorbent capacity of the products of this invention can be about 300 weight percent or greater, preferably about 400 weight percent or greater, and suitably from about 400 to about 550 weight percent. The procedure used to measure oil absorbent capacity is measured in accordance with Federal Specification UUT 595B.

The products of this invention exhibit an oil absorbent rate of about 20 seconds or less, preferably about 10 seconds or less, and more preferably about 5 seconds or less. Oil absorbent rate is measured in accordance with Federal Specification UU-P-31b.

The following examples are simply intended to further illustrate and explain the present invention. This invention, therefore, should not be limited to any of the details in these examples.

EXAMPLE 1

This example demonstrates an experiment designed to determine the relative odor intensity of compounds released from through-dried cellulosic base sheets manufactured by a conventional Un-Creped Through-Air Dried (UCTAD) process without addition of a malodor inhibiting antioxidant to the aqueous suspension of papermaking fibers. The experiment employed a CHARM analysis to determine the relative odor intensity of each compound. The CHARM protocol is described generally, for example, by Acree et al. in *Food Chem.*, 184:273–86 (1984), which is incorporated herein by reference. As described by Acree et al., the CHARM analysis comprises sequentially diluting a series of samples to determine the strongest smelling components of a sample.

The experiment comprised wetting samples of through-dried cellulosic base sheets (ranging from about 6 to about 20 g of pulp) with water. The gases evolved from the wetted base sheets were concentrated onto a sorbent trap commercially available from Envirochem, Inc. and containing 150 mg each of glass beads/Tenax TA/Ambersorb/charcoal and then thermally desorbed into a gas chromatograph (GC) (such as a HP 5890 GC commercially available from Hewlett-Packard, Inc.) and/or a gas chromatograph/mass spectrometer (GC/MS) (such as a HP 5988 commercially available from Hewlett-Packard, Inc.). The gas chromatograph was also fitted with a sniffer port to allow the operator to determine if the eluted compounds had an odor, a procedure described as gas chromatograph olfactometry (GCO). Each eluted compound that produced an odor at the sniffer port was recorded. A voice actuated tape recorder was used to record sensory impressions. The sample was then diluted and analyzed again.

Different sample sizes were analyzed until no odor components could be detected. The largest sample size (16 g) was analyzed three times to ensure that all odorous compounds were detected. Thereafter, only the retention times of compounds determined to be odorous were evaluated in duplicate. Each successive sample was diluted to comprise one-third the amount of material of the previous sample.

Results and Discussion

The GC/MS chromatograms indicated that numerous compounds were evolved from the re-wetted through-dried cellulosic base sheets. In a typical analysis, each peak of the chromatograms would be assigned to a particular chemical and a literature search would be undertaken to determine which of the chemicals have an odor. Since relatively few compounds have published odor thresholds, it would be difficult to determine whether an individual chemical would be odorous at the concentrations present in the sample. Thus, the ability to determine which peaks are odorous using GCO greatly simplifies the task of identifying the compounds responsible for the odor.

From all the compounds detected, only 17 peaks were found to possess an odor by GCO. CHARM analysis determined that two peaks accounted for more than 70% of the odor intensity, with four peaks comprising 85% of the odor intensity. From the combination of CHARM and GC/MS analysis, it is clear that the odor can be attributed to aldehydes. The most odorous compounds appear to be $C_7$–$C_{10}$ aldehydes (e.g., octanal, nonanal, and decanal) which have odor thresholds typically ranging from about 100 parts per trillion (ppt) to about 3 parts per billion (ppb).

EXAMPLE 2

This example demonstrates the introduction of isoascorbic acid into an aqueous suspension of papermaking fibers as a treatment for reducing malodor released by re-wetting dried handsheets made from the papermaking fibers.

Recycled paper fibers (1.2 grams) were blended with 120 ml of water and the mixture combined with approximately 3000 ml of water in a laboratory handsheet mold operable to selectively drain liquid through a porous mesh bottom. The aqueous suspension of fibers in the mold was agitated to disperse the fibers throughout the suspension. Approximately 1 ml of a 10% aqueous solution of isoascorbic acid was added to the suspension in the mold. Liquid was then allowed to drain through the mesh bottom of the mold and the resulting web was wet pressed just enough to allow the web to be removed from the mesh bottom. The partially dewatered web was dried in an oven at a temperature of 191° C. for 8 minutes. An untreated handsheet (i.e., without addition of isoascorbic acid) was prepared for purposes of comparison.

The handsheet treated with isoascorbic acid and the untreated handsheet were subjected to odor panel testing by eleven panelists using a paired comparison format. The dried handsheets were slightly misted with a water spray and the panelists were asked to smell the re-wetted handsheets and select the sample (treated or untreated) that had the most objectionable odor. The procedure was repeated (i.e., two replicates).

There was a significant statistical difference at the 99% confidence level with the untreated handsheet being selected as having the more objectionable odor 83% of the time as compared to 17% for the handsheet treated with isoascorbic acid.

EXAMPLE 3

Samples of the handsheet treated with isoascorbic acid and the untreated handsheet prepared in Example 2 were subjected to gas chromatography/mass spectroscopy (GC/MS) to determine the relative concentrations of key volatile organic compounds emitted from the handsheets upon being re-wetted.

Samples of each handsheet (approximately 6 grams) were inserted into a desorption tube while it was attached to an Envirochem Unacon 810 dynamic headspace unit. Deionized water (6 ml) was injected onto the sample and the tube was immediately capped to prevent escape of volatile components and the collection of the off-gasses began with the initial carrier flow (See Table 1).

TABLE 1

Envirochem Unacon 810: Conditions

| | |
|---|---|
| Initial Carrier Flow | 45 minutes |
| Secondary Carrier Flow | 2 minutes |
| Trap to Trap Time | 4 minutes |
| Trap to Column Time | 0 minutes |
| Trap 1 | 240° C. |
| Trap 2 | 240° C. |
| Transfer Line A | 240° C. |
| Transfer Line B | 240° C. |
| Trap Sorbent | Glass Beads/Silica Gel/Tenax/Ambersorb/ Charcoal |

The Envirochem unit sets off an exterior signal to start the gas chromatographic (GC) analysis when it switches to the trap to column flow. The mass spectrometer (MS) begins data collection from the start of the run. The GC/MS instrumental conditions are summarized in Table 2 below.

TABLE 2

The Gas Chromatography/Mass Spectroscopy Instrumental Conditions

| | |
|---|---|
| Instrument: | Hewlett-Packard 5890 Series II Plus Gas Chromatography/5989B Mass Spectrometer |
| Column: | J&W DB-1 (60 m, 0.25 mm ID, 0.25$\mu$ film.) |
| Oven Program: | Initial Temperature 50° C.<br>Initial Time 2.0 minutes<br>Rate 5° C./minute<br>Final 325° C./minute<br>Total Run Time 69.00 minutes |
| Carrier Gas: | Helium at 20.8 psi<br>1.40 ml/minute Constant Flow Rate |
| Detector: | Source Temperature 200° C.<br>Quadrapole Temperature 100° C. |
| Scan Range: | 35–400 dalton |
| Threshold | 100 dalton |

The relative concentrations of key volatile or organic compounds emitted during GC/MS analysis of the treated and untreated handsheets are set forth below in Table 3 in terms of the Total Ion Chromatogram (TIC) Peak Area values.

The relative concentrations of nonanal, octanal, heptanal, hexanal and 3-methyl butanal significantly decreased after release from treated sheets when compared to untreated handsheets. These odorous compounds are believed to be formed by the oxidation of unsaturated fatty acids embedded within the pulp fibers. Several of these compounds have extremely low odor threshold levels, in the magnitude of a few ppb. The significant decrease of the concentrations of these oxidizing aldehydes released from treated sheets suggests that the addition of isoascorbic acid to the aqueous solution of papermaking fibers inhibited auto-oxidation, thereby limiting the formation of the volatile, malodorous compounds. The relative concentrations of 2-methyl furan and furan increased when emitted from the handsheets treated with isoascorbic acid. This data does not necessarily exclude the furans as contributors to the odors. Perhaps the addition of the antioxidant prevented these compounds from directly contributing to the odor by inhibiting the furans and from further reacting, thereby limiting the formation of other odorous compounds.

| | | Total Ion Chromatogram (TIC) Peak Area | | |
|---|---|---|---|---|
| Compound | Re-tention Time | Untreated Handsheet | Isoacsorbic Acid Treated Handsheet | Odor |
| Furan | 8.163 | 190552 | 605738 | |

-continued

| Compound | Retention Time | Total Ion Chromatogram (TIC) Peak Area: Untreated Handsheet | Isoacsorbic Acid Treated Handsheet | Odor | |
|---|---|---|---|---|---|
| Diacetyl | 10.565 | 415292 | 28395 | Quinone | 1 |
| 2-Methyl furan | 11.265 | 82272 | 108218 | Ether-like | 2 |
| Chloroform | 11.529 | 82272 | 570263 | Characteristic | 1 |
| Ethylene dichloride | 12.295 | 233560 | 129667 | Pleasant | 1 |
| 3-Methyl butanal | 12.678 | 559076 | 66064 | Apple | 2 |
| 3-methyl-3-buten-2-one | 13.457 | 225179 | 137723 | | |
| 2,4-dimethylfuran | 15.054 | 75681 | 133742 | | |
| 1-methylpyrrole | 15.516 | 110939 | 28222 | | |
| 2-methyl-3-pentanone | 16.096 | 313627 | 72073 | | |
| Hexanal | 17.680 | 1097219 | 40640 | Sharp aldehyde | 2 |
| 2-(2-propenyl)-furan | 19.590 | 258703 | 38681 | | |
| p-xylene | 20.531 | 93585 | 47719 | | |
| Heptanal | 21.482 | 1089886 | 610944 | Penetrating fruity | 1 |
| Nonanol | 21.746 | 243464 | 243129 | Citronella oil | 1 |
| 6-methyl-5-hepten-2one | 24.518 | 390620 | 117422 | Lemongrass oil | 2 |
| 2-pentyl furan | 24.980 | 206945 | 119319 | | |
| Octanal | 25.099 | 3313460 | 975764 | Strong fruity | 2 |
| Limonene | 26.406 | 409828 | 35727 | Pleasant lemon-like | 1 |
| Nonanal | 28.504 | 8719382 | 2493072 | Orange-rose | 2 |

1 The Merck Index, Tenth Edition
2 Hawley's Condensed Chemical Dictionary, Eleventh Edition In view of the above, it will be seen that the several objects of the invention are achieved and other advantageous results attained.

The present invention is not limited to the above embodiments and can be variously modified. The above description of the preferred embodiments, including the Examples, is intended only to acquaint others skilled in the art with the invention, its principles, and its practical application so that others skilled in the art may adapt and apply the invention in its numerous forms, as may be best suited to the requirements of a particular use.

With reference to the use of the word(s) comprise or comprises or comprising in this entire specification (including the claims below), unless the context requires otherwise, those words are used on the basis and clear understanding that they are to be interpreted inclusively, rather than exclusively, and that each of those words is to be so interpreted in construing this entire specification.

What is claimed is:

1. A process for manufacturing a cellulosic paper product, the process comprising:

forming an aqueous suspension of papermaking fibers;

introducing a malodor inhibiting agent into said aqueous suspension of papermaking fibers, said malodor inhibiting agent comprising a compound selected from the group consisting of isoascorbic acid, L-ascorbic acid and mixtures thereof;

depositing said aqueous suspension of papermaking fibers onto a sheet-forming fabric to form a wet web; and through-drying said wet web by passing a heated gas through said wet web.

2. A process as set forth in claim 1 wherein said malodor inhibiting agent comprises isoascorbic acid.

3. A process as set forth in claim 1 wherein said malodor inhibiting agent is introduced into said aqueous suspension of papermaking fibers in an amount of at least about 1% by weight based on the weight of papermaking fibers in said aqueous suspension.

4. A process as set forth in claim 3 wherein said malodor inhibiting agent is introduced into said aqueous suspension of papermaking fibers in an amount of from about 1% to about 10% by weight based on the weight of papermaking fibers in said aqueous suspension.

5. A process as set forth in claim 4 wherein said malodor inhibiting agent is introduced into said aqueous suspension of papermaking fibers in an amount of from about 1% to about 5% by weight based on the weight of papermaking fibers in said aqueous suspension.

6. A process as set forth in claim 1 wherein said malodor inhibiting agent introduced into said aqueous suspension of papermaking fibers is dissolved in a solution.

7. A process as set forth in claim 6 wherein said solution comprises water as a solvent.

8. A process as set forth in claim 1 wherein said malodor inhibiting agent is introduced into said aqueous suspension of papermaking fibers prior to depositing said aqueous suspension onto said sheet-forming fabric.

9. A process as set forth in claim 1 wherein said aqueous suspension of papermaking fibers into which said malodor inhibiting agent is introduced has a dry weight consistency of no greater than about 20%.

10. A process as set forth in claim 9 wherein said aqueous suspension of papermaking fibers into which said malodor inhibiting agent is introduced has a dry weight consistency of no greater than about 5%.

11. A process as set forth in claim 10 wherein said aqueous suspension of papermaking fibers into which said malodor inhibiting agent is introduced has a dry weight consistency of no greater than about 2%.

12. A process as set forth in claim 1 wherein said wet web is partially dewatered prior to through-drying said wet web.

13. A process as set forth in claim 1 wherein said wet web is through-dried by passing air heated to a temperature of at least about 175° C. through said wet web.

14. A process as set forth in claim 13 wherein the air passed through said wet web is heated to a temperature of at least about 180° C.

15. A process as set forth in claim 14 wherein the air passed through said wet web is heated to a temperature of at least about 190° C.

16. A process as set forth in claim 15 wherein the air passed through said wet web is heated to a temperature of from about 190° to about 210° C.

17. A process as set forth in claim 16 wherein the air passed through said wet web is heated to a temperature of from about 200° to about 205° C.

18. A process for manufacturing a cellulosic paper product, the process comprising:

forming an aqueous suspension of papermaking fibers;

introducing isoascorbic acid into said aqueous suspension of papermaking fibers;

depositing said aqueous suspension of papermaking fibers containing isoascorbic acid onto a sheet-forming fabric to form a wet web; and through-drying said wet web by passing air heated to a temperature of at least about 175° C. through said wet web.

19. A process as set forth in claim 18 wherein isoascorbic acid is introduced into said aqueous suspension of papermaking fibers in an amount of at least about 1% by weight based on the weight of papermaking fibers in said aqueous suspension.

20. A process as set forth in claim 19 wherein isoascorbic acid is introduced into said aqueous suspension of papermaking fibers in an amount of from about 1% to about 10% by weight based on the weight of papermaking fibers in said aqueous suspension.

21. A process as set forth in claim 20 wherein isoascorbic acid is introduced into said aqueous suspension of papermaking fibers in an amount of from about 1% to about 5% by weight based on the weight of papermaking fibers in said aqueous suspension.

22. A process as set forth in claim 18 wherein said aqueous suspension of papermaking fibers into which isoascorbic acid is introduced has a dry weight consistency of no greater than about 5%.

23. A process as set forth in claim 22 wherein said aqueous suspension of papermaking fibers into which isoascorbic acid is introduced has a dry weight consistency of no greater than about 2%.

24. A process as set forth in claim 18 wherein said wet web is partially dewatered prior to through-drying said wet web.

25. A process as set forth in claim 18 wherein the air passed through said wet web is heated to a temperature of at least about 180° C.

26. A process as set forth in claim 25 wherein the air passed through said wet web is heated to a temperature of at least about 190° C.

27. A process as set forth in claim 26 wherein the air passed through said wet web is heated to a temperature of from about 190° to about 210° C.

28. A process as set forth in claim 27 wherein the air passed through said wet web is heated to a temperature of from about 200° to about 205° C.

* * * * *